US007025190B2

(12) United States Patent
King

(10) Patent No.: US 7,025,190 B2
(45) Date of Patent: Apr. 11, 2006

(54) COIN VALIDATION BY SIGNAL PROCESSING

(75) Inventor: Katharine Louise King, Hampshire (GB)

(73) Assignee: Mars, Incorporated, McLean, VA (US)

( * ) Notice: Subject to any disclaimer, the term of this patent is extended or adjusted under 35 U.S.C. 154(b) by 273 days.

(21) Appl. No.: 10/616,713

(22) Filed: Jul. 10, 2003

(65) Prior Publication Data

US 2004/0211645 A1 Oct. 28, 2004

(30) Foreign Application Priority Data

Jul. 31, 2002 (EP) ..... 02255070

(51) Int. Cl.
*G07D 5/00* (2006.01)

(52) U.S. Cl. ..... 194/302; 194/327

(58) Field of Classification Search ..... 194/302, 194/205, 211, 212, 303, 327
See application file for complete search history.

(56) References Cited

U.S. PATENT DOCUMENTS

| | | | | |
|---|---|---|---|---|
| 3,918,563 | A | | 11/1975 | Schwippert et al. |
| 4,733,766 | A | | 3/1988 | Roberts et al. |
| 4,848,556 | A | | 7/1989 | Shah et al. |
| 5,062,518 | A | * | 11/1991 | Chitty et al. ..... 194/317 |
| 5,407,049 | A | | 4/1995 | Jacobs |
| 5,407,051 | A | | 4/1995 | Wohlrab |
| 5,469,952 | A | * | 11/1995 | Kershaw et al. ..... 194/317 |
| 6,138,813 | A | | 10/2000 | Lamb, Jr. et al. |
| 6,247,573 | B1 | | 6/2001 | Itako et al. |
| 2001/0013458 | A1 | | 8/2001 | Sugata |

FOREIGN PATENT DOCUMENTS

| | | |
|---|---|---|
| CH | 645201 | 9/1984 |
| CH | 661350 | 7/1987 |
| EP | 0 543 212 A1 | 5/1993 |
| EP | 1 725 374 A2 | 7/1996 |
| EP | 0 977 158 A2 | 7/1998 |
| EP | 1 098 270 A1 | 5/2001 |
| GB | 2 094 008 A | 9/1982 |
| GB | 2 236 609 A | 4/1991 |
| WO | WO 83/00400 | 2/1983 |

OTHER PUBLICATIONS

G.R. Crane, "Poly (vinylidene) Fluoride Used for Piezoelectric Coin Sensors," IEEE Trans. On Sonics and Ultrasonics, vol. SU-25, No. 6, pp. 393-395 (Nov. 1978).

* cited by examiner

*Primary Examiner*—Donald P. Walsh
*Assistant Examiner*—Mark J. Beauchaine
(74) *Attorney, Agent, or Firm*—Fish & Richardson P.C.

(57) ABSTRACT

A method of validating coins which includes a piezoelectric element to convert movement caused by the collision of a coin to a signal and a processor to analyse the signal. The signal is digitized to produce a sequence of values. The processor analyses portions of the digitized signal to derive characterizing features of the signal and discriminates between valid and invalid coins based on the characterizing features.

23 Claims, 5 Drawing Sheets

COIN VALIDATION BY SIGNAL PROCESSING

This invention is concerned with the validation of coins, a process which is, for example, used by vending machines to receive payment for goods which are then dispensed.

In general, coin validators are well known in the art and an example thereof is disclosed in GB-A-2 094 008.

There are generally two characteristics of the coins which are utilised in the validation process: size and composition. This invention is concerned with a determination of the composition of the coin.

A practice has arisen whereby counterfeit coins of one form or another are inserted into vending machines to procure goods without paying for them. Various kinds of counterfeit coins are produced of which one type is generally composed of a soft metal such as lead which has been cast or stamped to match the dimensions of a known coin. Counterfeit coins are known as 'slugs' but the word 'coin' shall be used herein to denote any object which has been inserted and the validity of which is to be tested.

If the composition of a coin can be accurately determined, slugs can be rejected by the mechanism, thereby preventing theft.

One of the ways in which the composition of a coin can be tested is to measure the effects of an impact of the coin. Different materials have different densities and elastic properties which govern their behaviour when undergoing an impact. It has been found that a piezoelectric crystal can be used to translate the kinetic characteristics of an impact into electrical energy which can then be sampled and an acceptance decision made on the basis of the sample.

U.S. Pat. No. 4,848,556 discloses a coin validator wherein a coin is dropped onto a piezoelectric sensor and the output of the sensor is integrated to determine the mass of the coin.

The coin validator of WO-A-83/00400 includes a piezoelectric element onto which a coin falls and the output of the element is measured. Valid and invalid coins are discriminated based on an amplitude of the signal. Similarly, U.S. Pat. No. 5,469,952 discloses apparatus which also utilises the amplitude of a signal produced by a piezoelectric element as the basis for discriminating between valid and invalid coins.

These arrangements suffer from the disadvantage that the measurement made depends on the momentum of the coin when impacting the sensor. Variations in the height from which the coin is dropped or other factors influencing the velocity with which the coin impacts the sensor have a direct bearing on the reliability of the measurement and hence the discrimination process. Consistent discrimination decisions can therefore be problematic.

These problems are said to be at least partially overcome by a coin validator which includes a piezoelectric element wherein the time of impact of a coin with the element is measured to determine the characteristics of the coin, as disclosed in EP-A-0 543 212.

GB-A-2 236 609 discloses a coin validator incorporating a piezoelectric element where an impact with a coin produces vibrations of the element which are sampled to produce a signal. The signal is analysed and valid and invalid coins are discriminated based on a gradient of the signal. This measurement is also less sensitive to variations in the momentum of the coin when striking the surface.

According to a first aspect of the invention a method of validating a coin includes the steps of causing a collision between the coin and a surface, generating a signal indicative of resultant movement of the surface, identifying at least one time domain feature of the signal and making a validation decision based on at least one characteristic of the feature.

The feature may be identified relative to at least two points of inflection of the signal separated from succeeding points of inflection by at least a predetermined length.

A plurality of features may be identified wherein the predetermined length is varied for the identification of the features.

According to a further aspect of the invention a method of validating a coin includes the steps of obtaining a signal from a collision of the coin and using features of the signal to determine coin validity where at least one parameter used in the identification of the features is dynamically variable.

According to a further aspect of the invention a method of validating a coin includes the steps of causing a collision between the coin and a surface, and digitally sampling the resultant movement of the surface to produce a sequence of values which are analysed for discrimination purposes.

According to a further aspect of the invention a method of validating a coin includes the steps of dividing a signal into portions in the time domain of greater and lesser average amplitude and analysing the portion of lesser average amplitude.

Both portions of the signal may be analysed.

According to a further aspect of the invention a method of validating a coin includes the steps of analysing a signal and validating a coin on the basis of the signal analysis wherein the analysis is triggered by a trigger having a positive and a negative threshold which are independently variable.

According to a further embodiment of the invention a method of validating a coin includes the steps of analysing a signal produced by a collision of a coin with a surface and terminating the analysis if either a valid coin is found or if a predetermined time has elapsed.

Other embodiments and preferred features will be apparent from the following description and claims.

Arrangements embodying the invention will now be described by way of example with reference to the accompanying drawings, in which.

Figure 1:
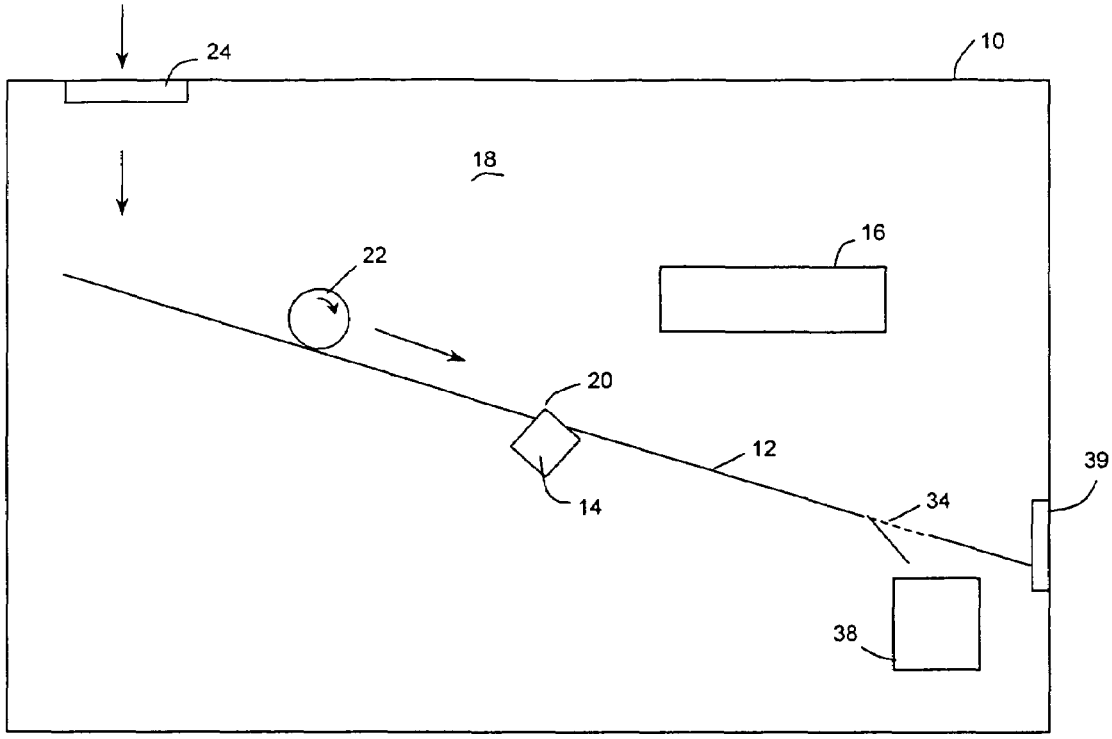
FIG. 1 is a schematic representation of a portion of a coin validator according to a first embodiment.

Referring to FIG. 1, a coin validator 10 includes a ramp 12 in which is inserted a bar 14 running transversely across the ramp 12. A piezoelectric element 16 is mounted to a lid 18 of the validator. The bar 14 is composed of tungsten carbide which is a harder material than the materials from which both valid coins and slugs are composed and has a sharp edge 20 which runs across the ramp 12.

When a coin 22 is inserted into a slot 24 of the validator 10, it falls and strikes the ramp 12. The coin 22 then rolls down the ramp 12 and collides with the edge 20 of the bar 14 and then continues to roll down the ramp 12. This sets up vibrations in the bar 14 which are translated to the piezoelectric element 16 by means of the lid 18.

Figure 2:
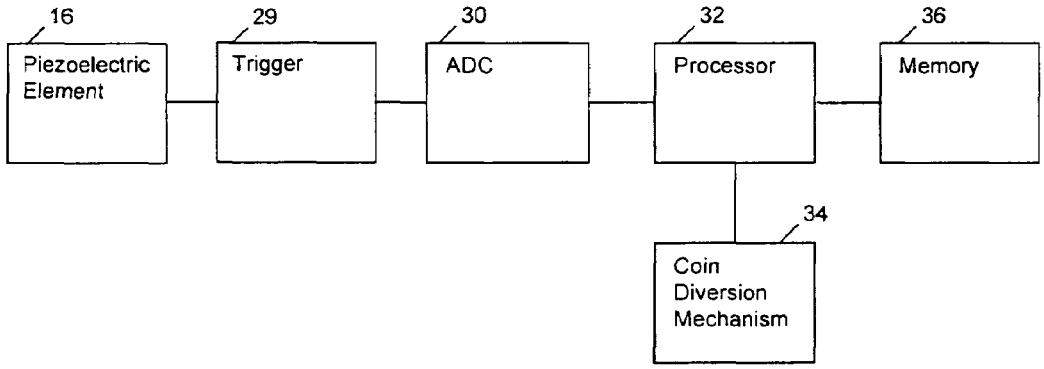
FIG. 2 is a schematic representation of a further portion of the coin validator of FIG. 1.

Referring to FIG. 2, the piezoelectric element 16 is connected to a trigger 29 which is connected to an Analogue-to-Digital converter (ADC) 30. The ADC 30 is connected to a processor 32 which is, in turn, connected to a coin diversion mechanism 34. Signals from the piezoelectric element 16 are sampled by the ADC 30 and analysed by the processor 32. The processor 32 operates the coin diversion mechanism 34 on the basis of its analysis of the signal in the manner described hereinafter. The coin diverting mechanism 34 is operable to direct the coin to a coin store 38 if valid or to a return slot 39 where the coin is returned to a user if not valid.

Figure 3:
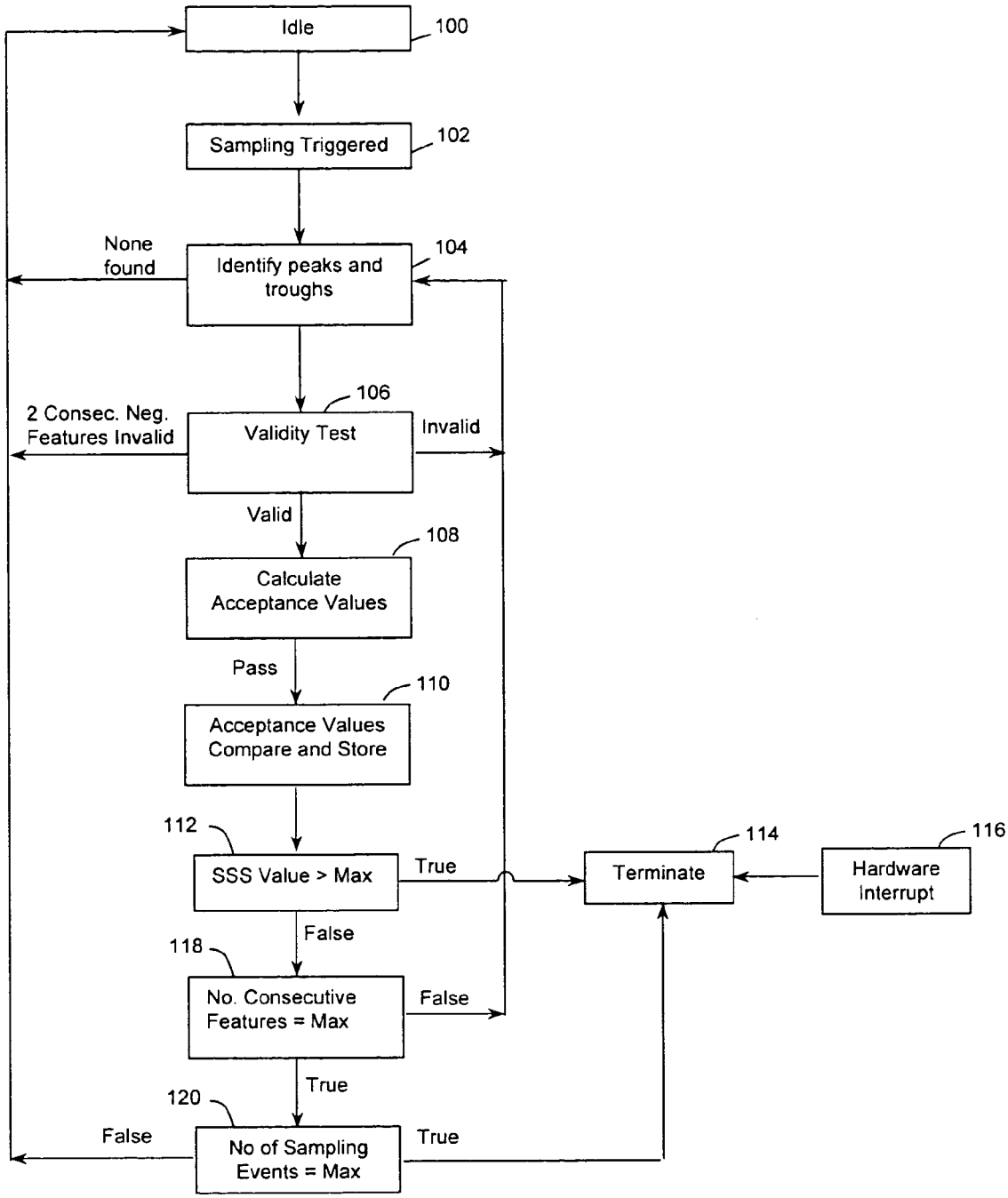
FIG. 3 is a flow diagram for a sampling procedure of the processor of the coin validator of FIG. 1.

FIG. 3 is a flow diagram illustrating the analysis of the signal and the derivation of values (the 'SSS Value') which are indicative of whether the coin is valid or not.

The processor 32 controls other operations of the coin validator 12 in addition to analysing the signal. Therefore a time window is defined in which the processor samples the signal from the ADC 30 and a hardware interrupt 116 may cause termination 114 of the signal at any time.

Figure 4:
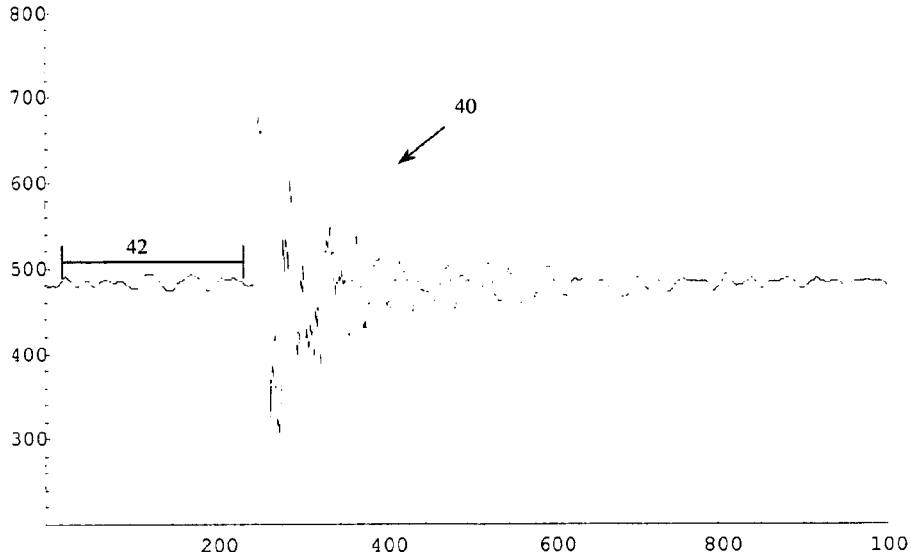
FIG. 4 illustrates a signal obtained by the coin validator of FIG. 1.

The idle state of the system is represented at 100. This corresponds to no or a negligibly small signal 42 (FIG. 4) generated by the piezoelectric element 16. Sampling is triggered by the trigger 29 at step 102 by a positive or a negative offset from the signal idle as it has been found that the initial offset may occur in either direction. The threshold for the positive and the negative triggers are independently set and can be varied.

Figure 5:
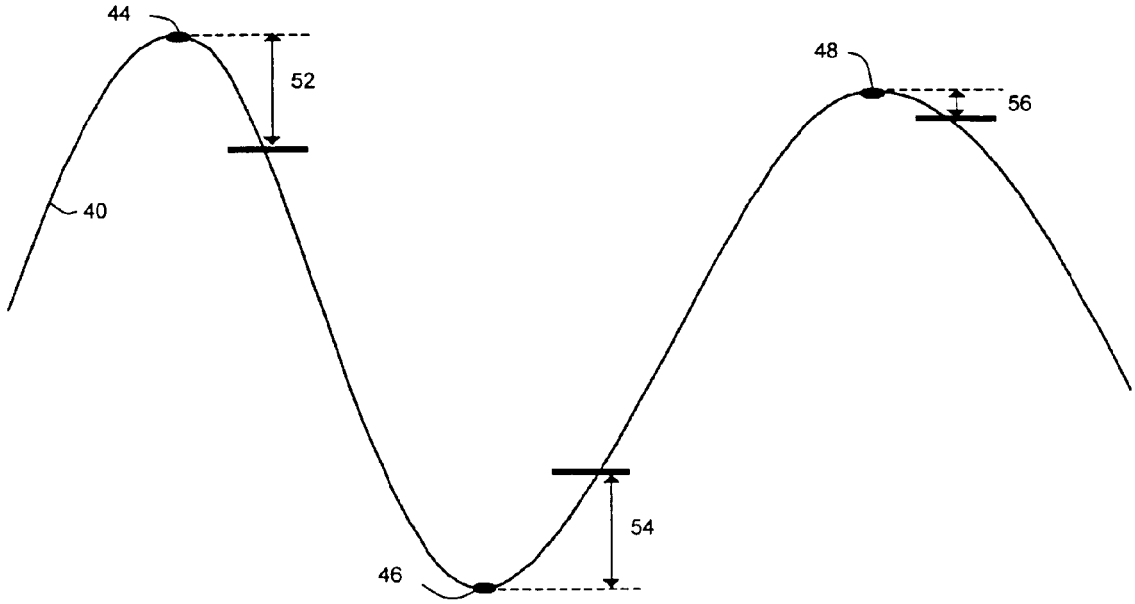
FIG. 5 is a schematic depiction of a portion of the signal of FIG. 4.

Once the processing has been triggered, points of local maximum negative and positive excursion of the signal are identified at step 104. For ease of reference, a point of local maximum positive excursion shall be referred to as a 'peak' and a point of local maximum negative excursion shall be referred to as a 'trough'. FIG. 5 illustrates a portion of a signal 40 which includes a first peak 44, a trough 46 and a second peak 48. Once the sampling operation has been triggered at step 102 (FIG. 3), the points 44, 46 and 48 are defined as those points after which the slope of the signal alters sign (from positive to negative or from negative to positive) for a predetermined length, labelled the Turn Length 52, 54, 56. This Turn Length allows the processor to ignore intermittent changes in the sign of the slope which might not indicate a true maximum of positive or negative excursion. This is illustrated in FIG. 6 where the local peaks 50 are ignored as the corresponding Turn Length has not been exceeded by the time the gradient changes sign again.

If no peaks or troughs are identified, the system returns to the idle state 100.

Once the first pair of peaks and troughs has been defined, the portion of the signal corresponding to this pair is analysed.

Figure 6:
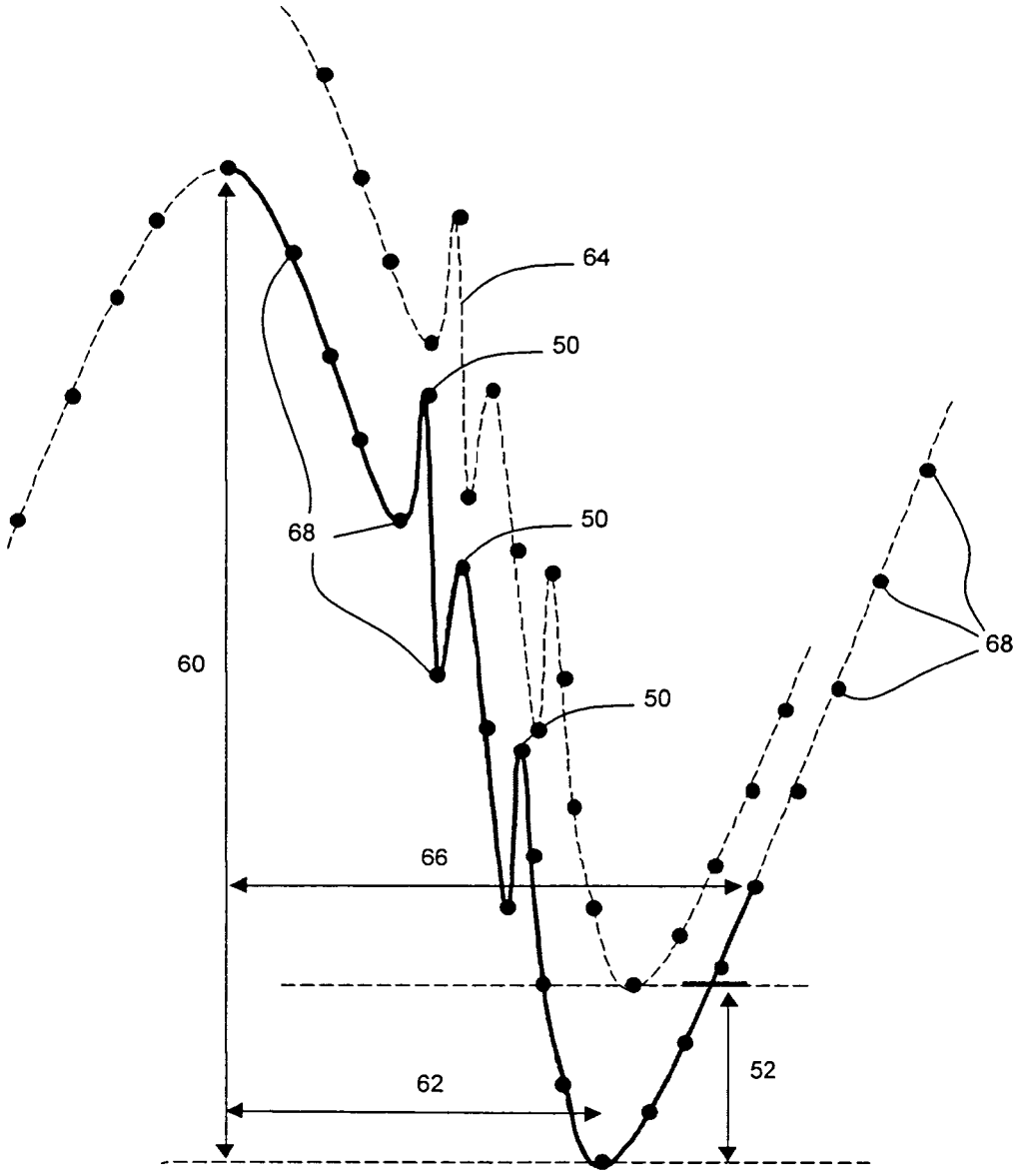
FIG. 6 is a schematic depiction of a further portion of the signal of FIG. 4.

Referring to FIG. 6, a Feature is defined as that portion of the signal which begins at a peak or a trough and which extends past the Turn Length of the following trough or peak for two samples. A Feature therefore extends from a point of maximum polarity (such as peak) to a point defined in relation to the next occurring point of maximum opposite polarity (such as a trough). It is to be realised therefore that overlap between consecutive Features occurs.

A positive Feature is a Feature which begins at a trough whereas a negative Feature is one which begins at a peak.

If no Features are found in that the Turn Length is not exceeded by the signal, the system returns to the idle state 100. This allows false triggers to be ignored and will not occupy processor time for longer than necessary.

For each identified negative Feature, a validity test 106 (FIG. 3) is performed. The processor 32 performs this test as soon as the Feature has been identified. Advantageously, it is therefore not necessary for the signal to be stored in its entirety before being processed which would require significantly more memory.

The validity test utilises the following variables in respect of the Feature to be tested:

Feature Length (60, FIG. 6) which is defined as the amplitude between the peak and the trough of the feature;

Feature Time 62 which is the number of samples between the peak and the trough;

Feature Total Volts 64 which is the length of the curve of the signal from the beginning of the Feature (i.e. the peak) to a point two samples after the Turn Length; and Slot Count (66) which is the time (number of samples) corresponding to the Total Volts (64).

A Feature is deemed valid only if:

a) it is a negative Feature;

b) it is not the first Feature extracted after sampling was triggered;

c) the Feature Length is greater than a predetermined threshold; and d) Slot Count does not exceed a predetermined maximum.

If the test for the validity of the Feature fails, the succeeding portion of the signal will be analysed in the same manner, starting by identifying Features 104 and proceeding from there. If the validity test fails for two consecutive negative features, the system will return to the idle state 100.

For each valid Feature, an acceptance value, the SSS Value, is calculated at step 108 for that Feature where:

$$SSSValue \propto \frac{(FeatureTotalVolts)}{(FeatureTime)^2}$$

A suitable scaling factor is introduced when the value is calculated.

The collision of a coin when compared to a slug will produce a waveform which is more energetic (displaying a greater frequency) and contains additional higher frequency components.

As the SSS Value is related to the energy (Feature Total Volts) divided by time, a more energetic waveform will yield higher SSS Values. Therefore, a high SSS value is used as an indication that the coin is valid whereas a low value is taken to be suggestive of a slug.

Once the SSS Value has been calculated, it is compared against a stored value 110. The processor will maintain a record of the most significant SSS Value calculated.

At step 112 the stored SSS Value is compared against a maximum and if greater, the process will terminate 114. This is taken as an unambiguous indication that the coin is valid and the processor directs the coin to the coin store 38 (FIG. 1).

The number of consecutive Features which have been identified is compared against a reference value at step 118 and if less than that number, the process will return to identifying peaks and troughs at step 104. If the number of identified features is equal to the reference number, the total number of times the waveform has been sampled is compared against a predetermined number at step 120. The number of times the waveform has been sampled will correspond to the number of times the process has passed step 120. If this is equal to the predetermined number, the process is terminated 114. Otherwise, the system will return to the idle state 100 and await triggering.

The process of signal analysis may be terminated at any point by a hardware interrupt 116. This marks the end of the window which was earmarked for signal analysis and the processor may then continue with other necessary tasks.

In the preferred embodiment, two distinct SSS Values are calculated, each corresponding to distinct valid Features.

By incorporating two values to test for validity, it is possible to analyse the signal for two characteristics. This is useful as coins of differing denominations can be differentiated over slugs by distinct characterising features. For example, the £1 (GBP) coin exhibits the most marked differentiation over a slug engineered to mimic the coin at the beginning of the signal (the portion of the signal which exhibits relatively large amplitudes). The 20 pence (GBP) coin on the other hand, although also displaying a differentiation over a slug in the initial portion of the signal, has a clear differentiation over slugs in a later portion of the signal (where the amplitude of the signal is relatively small).

The processor at step 108 of FIG. 3 calculates either of two values on which discrimination is based: SSS Value 1 and SSS Value 2. Once a value for SSS Value 1 has been calculated, the Turn Length criteria at step 104 as well as the criteria used in the validity test at step 106 are altered and a value for SSS Value 2 is calculated. The sets of criteria are chosen so that SSS Value 1 is derived from Features corresponding to lower frequency and higher amplitude whereas SSS Value 2 is derived from Features corresponding to higher frequency and lower amplitude. A particular SSS Value is therefore indicative of validity of a particular coin denomination.

At step 110 then, the two SSS Values are compared against stored values and the higher value retained for each comparison.

Once the processing of the signal has terminated, a validity decision is made. The SSS Values as well as the Feature Total Volts and the Feature Time corresponding to the Features for which those values were calculated is used to determine the likely denomination of the coin being tested and on this basis a choice between SSS Value 1 and SSS Value 2 is made. The chosen value is then used to make a determination of the validity of the coin.

The processor is therefore able to make a dynamic distinction between two sets of criteria which characterise two different coin types.

Figure 7:
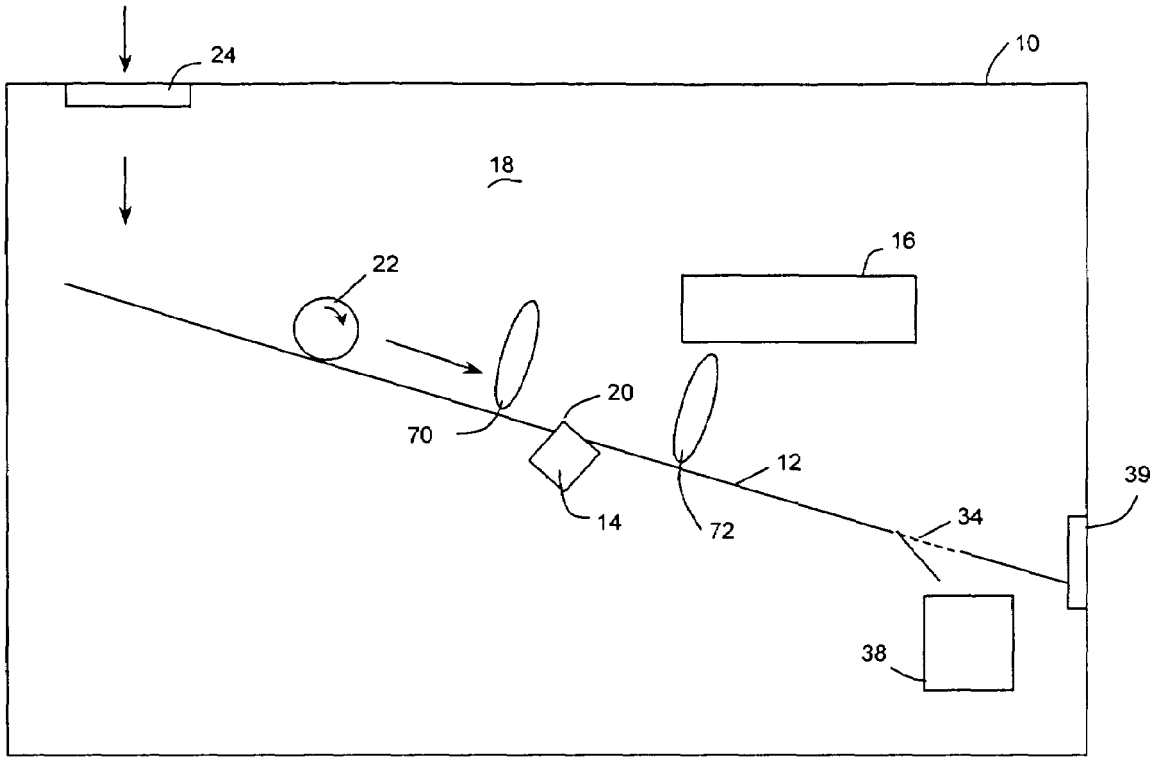
FIG. 7 is a schematic representation of a portion of a coin validator according to a further embodiment.

FIG. 7 is a schematic representation of a portion of a coin validator according to a further embodiment where like numerals are used for like features. The coin validator includes a first inductor 70 and a second inductor 72. As the coin 22 rolls down the ramp, it passes the first inductor 70, then impacts with the edge 20 of the bar 14 and then passes the second inductor 72. The inductors 70 and 72 are connected to the processor 32 which analyses signals generated by the respective conductors.

The use of inductors in the validation of coins is well known in the art and will not be further described herein. A coin validator which includes inductors is disclosed in GB-A-1 397 083 which is incorporated herein by reference. In this embodiment however, the processor 32 combines information obtained from the inductors 70 and 72 with the SSS Value obtained in the manner described with reference to the embodiment of FIG. 1 to discriminate between valid and counterfeit coins.

In this embodiment, the time window which the processor is allocated to analyse the signal from the piezoelectric element 16 is delineated by the activities which the processor is required to perform when the coin passes the inductors 70 and 72. The start of the window is marked by the end of the necessary processing in respect of inductor 70 plus a predefined offset and the end is marked by the start of the processing necessary in respect of inductor 72 (corresponding to the interrupt 116).

It is not necessary for the processor to calculate two SSS Values for each portion analysed as the information obtained from the first inductor 70 is used as an initial indication of the denomination of the coin. Once the SSS Value is calculated, this is combined with information obtained by the processing of the signals generated by the inductors to determine whether the coin is valid. The use of multiple information sources to determine coin validity is well known in the art and is disclosed, for example, in EP-A-496 754 which is incorporated herein by reference.

Many other modifications and variations will be apparent to the skilled person. The invention extends to any and all such modifications and variations. For the avoidance of doubt, protection is hereby claimed for any and all novel subject matter, singularly or in combination, which is disclosed herein.

The invention claimed is:

1. A method of validating a coin which includes the steps of causing a collision between the coin and a surface, generating a signal indicative of resultant movement of the surface, identifying at least one time domain feature of the signal and making a validation decision based on at least one characteristic of the feature wherein the feature is defined by at least two points of inflection of the signal.

2. The method of claim 1 wherein said two points of inflection of the signal are each separated from succeeding points of inflection by at least a predetermined length.

3. The method of claim 2 which includes the step of identifying a plurality of features based on a plurality of predetermined lengths.

4. The method of claim 3 which includes the step of calculating an acceptance value for at least one feature used in the validation decision wherein the acceptance value is derived from measurements of change in amplitude and duration of the signal for the corresponding feature.

5. The method of claim 4 wherein the acceptance value is calculated for each feature which satisfies a validity test wherein the validity test is based on any one of:

an average gradient of the signal over the duration of the corresponding feature;

a location of the corresponding feature in the time domain;

a total length of the feature; or a time duration of the feature.

6. The method of claim 5 wherein each acceptance value is compared to at least one predetermined value, said comparison forming the basis for the validation.

7. The method of claim 6 wherein the acceptance value is proportional to a length described by the signal for the corresponding feature.

8. The method of claim 7 wherein the acceptance value is inversely proportional to the square of the duration of the signal for the corresponding feature.

9. The method of any preceding claim wherein a piezoelectric crystal is used to derive the signal.

10. A method of validating a coin which includes the steps of obtaining a signal from a collision of the coin and using features of the signal to determine coin validity where at least one parameter used in the identification of the features is dynamically variable.

11. A method of validating a coin which includes the steps of analyzing a signal and validating a coin on the basis of the signal analysis wherein the analysis is triggered by a trigger having a positive and a negative threshold which are independently variable.

12. A method of validating a coin which includes the steps of: analyzing a signal produced by a collision of a coin with a surface; terminating the analysis if a valid coin is found; and terminating the analysis if a predetermined time has elapsed.

13. A coin validator which includes a surface, means for obtaining a signal from movement of the surface, means for digitally sampling the signal to obtain a sample and a processor which produces a sequence of values based on the sample and uses the values to validate a coin, wherein the processor is configured to identify at least one time domain feature of the signal and make a validation decision based on at least one characteristic of the feature wherein the feature is defined by at least two points of inflection of the signal.

14. The coin validator of claim 13 wherein said two points of inflection of the signal are each separated from succeeding points of inflection by at least a predetermined length.

15. The coin validator of claim 14 wherein the processor is configured identify a plurality of features based on a plurality of predetermined lengths.

16. The con validator of claim 15 wherein the processor is configured to calculate an acceptance value for at least one feature used in the validation decision wherein the acceptance value is derived from measurements of change in amplitude and duration of the signal for the corresponding feature.

17. The coin validator of claim 16 wherein the processor is configured to calculate an acceptance value for each feature which satisfies a validity test wherein the validity test is based on any one of:

an average gradient of the signal over the duration of the corresponding feature;

a location of the corresponding feature in the time domain;

a total length of the feature; or a time duration of the feature.

18. The coin validator of claim 17 wherein the processor is configured to compare each acceptance value to at least one predetermined value, said comparison forming the basis for the validation.

19. The coin validator of claim 18 wherein the acceptance value is proportional to a length described by the signal for the corresponding feature.

20. The coin validator of claim 19 wherein the acceptance value is inversely proportional to the square of the duration of the signal for the corresponding feature.

21. The coin validator of any one of claims 13 through 20 comprising a piezoelectric crystal to generate the signal.

22. A coin validator which includes a surface, means for obtaining a signal from movement of the surface, means for digitally sampling the signal to obtain a sample and a processor which produces a sequence of values based on the sample and uses the values to validate a coin, wherein the processor is configured to analyze the signal and validate the coin based on the signal analysis wherein the analysis, the coin validator further including a trigger to the trigger the analysis, wherein the trigger has positive and negative thresholds that are independently variable.

23. A coin validator which includes a surface, means for obtaining a signal from a collision of the coin and a processor to determine coin validity using features of the signal wherein at least one parameter used in the identification of the features is dynamically variable.

* * * * *

UNITED STATES PATENT AND TRADEMARK OFFICE

CERTIFICATE OF CORRECTION

PATENT NO. : 7,025,190 B2
APPLICATION NO. : 10/616713
DATED : April 11, 2006
INVENTOR(S) : Katharine Louise King It is certified that error appears in the above-identified patent and that said Letters Patent is hereby corrected as shown below:

Title page, item (30) Foreign Application Priority Data, "Jul. 31, 2002" should be --Jul. 19, 2002--;

Col. 7, claim 16, line 24, "con" should be --coin--.

Signed and Sealed this

Sixteenth Day of January, 2007

JON W. DUDAS
*Director of the United States Patent and Trademark Office*